US010119347B2

(12) United States Patent
Johnson et al.

(10) Patent No.: US 10,119,347 B2
(45) Date of Patent: Nov. 6, 2018

(54) ALIGNING BOREHOLE DRILLING EQUIPMENT

(71) Applicant: SCHLUMBERGER TECHNOLOGY CORPORATION, Sugar Land, TX (US)

(72) Inventors: Ashley Bernard Johnson, Cambridge (GB); Paul Anthony Francis, London (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 115 days.

(21) Appl. No.: 14/676,853

(22) Filed: Apr. 2, 2015

(65) Prior Publication Data

US 2015/0285013 A1 Oct. 8, 2015

(30) Foreign Application Priority Data

Apr. 2, 2014 (GB) ..... 1405969.5

(51) Int. Cl.

| | |
|---|---|
| ***E21B 19/24*** | (2006.01) |
| ***E21B 33/06*** | (2006.01) |
| ***E21B 17/00*** | (2006.01) |
| ***E21B 33/08*** | (2006.01) |

(52) U.S. Cl.

CPC ..... *E21B 19/24* (2013.01); *E21B 17/00* (2013.01); *E21B 33/06* (2013.01); *E21B 33/085* (2013.01)

(58) Field of Classification Search

CPC ..... E21B 3/045; E21B 17/1042; E21B 19/24; E21B 33/06

(Continued)

(56) References Cited

U.S. PATENT DOCUMENTS 2,846,013 A * 8/1958 Davis ..... E21B 33/03 166/94.1
4,392,792 A * 7/1983 Rogers ..... F04B 47/04 417/400

(Continued)

FOREIGN PATENT DOCUMENTS

EP 0288979 A2 11/1988
WO 2011019888 A1 2/2011

(Continued)

OTHER PUBLICATIONS

Combined Search and Examination Report for related application No. 1405968.7, dated Oct. 8, 2014, 8 pages.

(Continued)

*Primary Examiner* — Cathleen R Hutchins

(57) ABSTRACT

Systems and methods are provided for aligning pressure drilling system equipment. According to such methods, a longitudinal axis of a shaft of the pressure drilling system is determined. An offset between the axis of the shaft and a longitudinal axis of a blowout preventer is determined. A first adjustment component is coupled with the blowout preventer. A second adjustment component is aligned relative to the first adjustment component based on the measured offset. The second adjustment component is coupled with the first adjustment component. A rotating control device is coupled with the second adjustment component such that an axis of the rotating control device corresponds with the axis of the shaft to account for the measured offset.

15 Claims, 5 Drawing Sheets

(58) Field of Classification Search
USPC ..... 414/22.54–22.61
See application file for complete search history.

(56) References Cited

U.S. PATENT DOCUMENTS

| | | | | |
|---|---|---|---|---|
| 4,747,454 | A * | 5/1988 | Perryman | G01B 11/272 166/380 |
| 5,345,829 | A | 9/1994 | Yamauchi et al. | |
| 5,448,924 | A | 9/1995 | Nagai et al. | |
| 6,865,934 | B2 | 3/2005 | Schultz et al. | |
| 2003/0226248 | A1* | 12/2003 | McGuffin | E21B 19/24 29/525.01 |
| 2006/0037744 | A1* | 2/2006 | Hughes | E21B 33/085 166/85.4 |
| 2007/0114039 | A1* | 5/2007 | Hobdy | E21B 33/03 166/379 |
| 2009/0315267 | A1 | 12/2009 | Castleman | |

FOREIGN PATENT DOCUMENTS

| | | | | |
|---|---|---|---|---|
| WO | WO2011/084159 | * | 7/2011 | E21B 33/06 |
| WO | 2015060836 | A1 | 4/2015 | |

OTHER PUBLICATIONS

Examination Report for corresponding GB Application Serial No. 1405969.5, dated Sep. 26, 2016, 3 pages.
Examination Report for related application No. 1405968.7, dated Jun. 26, 2017, 5 pages.

* cited by examiner

ALIGNING BOREHOLE DRILLING EQUIPMENT

CROSS REFERENCE TO RELATED APPLICATION(S)

This application claims priority to Great Britain Patent Application No. 1405969.5, filed Apr. 2, 2014. The disclosure of priority application is hereby incorporated by reference herein in its entirety.

BACKGROUND

Managed pressurized drilling operations utilize oil rigs having a pressurized drilling annulus. A rotating control device (RCD) is mounted atop the annulus and include a sealing element to seal the annulus, aiding in the creation of the pressurized drilling environment. Conventional condition detection for sealing elements in managed pressure drilling operation equipment is based on pressure measurement above and below the sealing element. In some cases, two sealing elements may be used to seal the annulus. Conventional monitoring of such systems involves measuring the pressure between the two sealing elements. Such pressure monitoring techniques are capable of detecting performance degradation associated with abrasive wear. However, catastrophic failure in managed pressurized drilling systems is often caused by sealing element fatigue and fracture, which are not detectable solely through these pressure measurements. As such, conventional condition detection does little to indicate impending failure of a sealing element. Additionally, conventional condition detection is hindered due to small leaks caused by dynamic movement of the pipe that can make it difficult for pressure measurements to serve as sole indicators of sealing element condition.

Moreover, lab tests of RCDs are made in purpose-built test rigs where tool joints are forced through RCD sealing elements. The failures seen in field installations stem from radial splitting and are different than the failures seen in lab test facilities, which involve symmetrical bulge type failure. There are also significant differences between the test and field geometries of the managed pressure drilling equipment. For example, in the test facilities, the pipe or shaft and sealing element are aligned to one another. However, in the field, the RCD and a blowout preventer (BOP) are aligned to the well head while the drill shaft is aligned to the rig, oftentimes causing misalignment. In conventional applications, any misalignment is taken up by the sealing element of the RCD. As a result, during rotation of the RCD, the sealing element can be subject to high cyclic loading and fatigue failure. Improvements in handling of alignment and sealing element condition monitoring are desired.

BRIEF SUMMARY

Embodiments of the present invention serve to provide methods and systems to improve tolerance of misalignment between the shaft aligned with the managed pressure drilling operation equipment of an oil rig and the RCD and BOP aligned with the well head. Embodiments of the invention further provide methods and systems for detecting the condition of RCD sealing elements such that a failure of the sealing element can be predicted. Embodiments of the present invention are generally related to managed pressure drilling equipment of oil rigs (hereinafter pressure drilling system).

In pressure drilling systems, the RCD and BOP are aligned to a well head, but the drill pipe or shaft is aligned to the rig. Due to aligning the RCD, BOP, and shaft with different components, misalignment between the RCD and shaft can result. In conventional applications, any misalignment is taken up by the sealing element of the RCD. Misalignment between the pressure drilling system equipment and a wellhead can result in the drill shaft being eccentric in the RCD. The eccentricity can produce side forces and lateral deformation in the rubber element, resulting in accelerated fatigue and early failure. Such failures can be very costly in terms of time to make an unscheduled replacement of the rubber sealing element. Additionally, the failure may cause other components to be damaged, thereby adding time to the replacement as well as the cost of replacement components.

Embodiments of the present invention provide alignment pieces to ensure that axes of the RCD, shaft, and the BOP are aligned within a desired tolerance. This ensures that any eccentricity in rotation of the RCD sealing element is minimized to reduce fatigue and failure rate of the sealing element. Embodiments of the present invention further provide sensors used to detect physical characteristics of the sealing element and drill equipment to monitor a condition of the sealing element. This allows a remaining life of the sealing element to be predicted so that a sealing element replacement can be scheduled prior to a catastrophic failure of the component, saving time and money.

In one aspect, embodiments of the present invention provide a method of aligning oil drilling equipment. The method can include determining a longitudinal axis of a shaft of a drilling rig. An offset between the axis of the shaft and a longitudinal axis of a blowout preventer can be determined. The method can also include coupling a first adjustment component with the blowout preventer. A second adjustment component may be aligned relative to the first adjustment component based on the measured offset. The second adjustment component may be coupled with the first adjustment component. The method can also include coupling a rotating control device with the second adjustment component such that an axis of the rotating control device corresponds with the axis of the shaft to account for the measured offset.

In some embodiments, determining the longitudinal axis includes attaching a laser device to a bottom of the shaft such that a beam of the laser device corresponds to the longitudinal axis, moving the shaft, and monitoring a position of the beam produced by the laser device. In one embodiment, the determining the longitudinal axis further includes rotating the shaft and monitoring a position of the beam. Determining the longitudinal axis can also include coupling a plumb line with the shaft to detect the longitudinal axis. In some embodiments, the first and second adjustment components each include an angled middle portion coupled with one or more flanged ends. In some embodiments, the method may also include positioning a sealing component between the shaft and the rotating control device. The sealing component can be a rubber annular disc.

In another aspect, an embodiment of the present invention provides a method of aligning oil drilling equipment. The method can include determining a longitudinal axis of a shaft of a drilling rig. An offset of between the axis of the shaft and a longitudinal axis of a blowout preventer can be determined. The method also can include coupling an adjustment component with the blowout preventer. A rotating control device can be coupled with the adjustment component such that an axis of the rotating control device corresponds with the axis of the shaft to account for the offset.

In some embodiments, determining the longitudinal axis can include attaching a laser device to a bottom of the shaft such that a beam of the laser device corresponds to the longitudinal axis, moving the shaft, and monitoring a position of the beam produced by the laser device. Determining the longitudinal axis can further include rotating the shaft and monitoring a position of the beam. In some embodiments, determining the longitudinal axis comprises coupling a plumb line with the shaft to detect the longitudinal axis. In some embodiments, the first and second adjustment components each include an angled middle portion coupled with one or more flanged ends. The method may also include positioning a sealing component between the shaft and the rotating control device. The sealing component can be a rubber annular disc.

One aspect of an embodiment of the present invention provides a system of equipment of a managed pressure drilling operation being carried out on an oil rig. The system can include a shaft of a drilling rig. The shaft can have a shaft axis. The system can further include a blowout preventer coupled with a top end of a well bore. The blowout preventer can be configured to receive the shaft and can include a longitudinal axis that is radially offset from the shaft axis. The system can include a rotating control device. An alignment component can be coupled with one or both of the rotating control device and the blowout preventer such that an axis of the rotating control device is adjusted relative to the blowout preventer via the alignment component.

In some embodiments, the alignment component includes a bearing that enables rotation of a first portion of the rotating control device and enables a second portion of the rotating control device to tilt. The alignment component can include one or more pieces positioned between the rotating control device and the blowout preventer. Each piece can include an angled middle portion coupled with one or more flanged ends. In one embodiment, the system can include a sealing element coupled with the rotating control device to provide a seal against an outside of the shaft. The sealing element can include a rubber annular disc. In some embodiments, the sealing element is sufficiently elastic to allow one or more joints on the shaft to be pulled through the sealing element while maintaining a seal before, during, and after the joints are pulled through the sealing element. In one embodiment, the alignment component includes a pair of components that are radially movable relative to one another.

In one aspect, an embodiment of the present invention provides a component for a pressure drilling system configured to accommodate an offset between an axis of a shaft of the pressure drilling system and an axis of a blowout preventer. The component can include an alignment component coupleable with a rotating control device and the blowout preventer such that an axis of the rotating control device is shifted radially relative to the blowout preventer via the alignment component. The alignment component can include a middle portion coupled with one or more flanged ends. The middle portion can have a longitudinal axis that is at an angle relative to a longitudinal axis of the blowout preventer. The alignment component is radially movable relative to one or more of the blowout preventer and the rotating control device to account for the offset. In one embodiment the component can further include a pair of alignment components that are coupleable with each other and further coupleable with the rotating control device and blowout preventer so as to radially shift the axis of the rotating control device relative to the axis of the blowout preventer. The pair of alignment components are radially movable relative to one another.

The above described and many other features and attendant advantages of embodiments of the present invention will become apparent and further understood by reference to the following detailed description when considered in conjunction with the accompanying drawings.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Figure 1A:
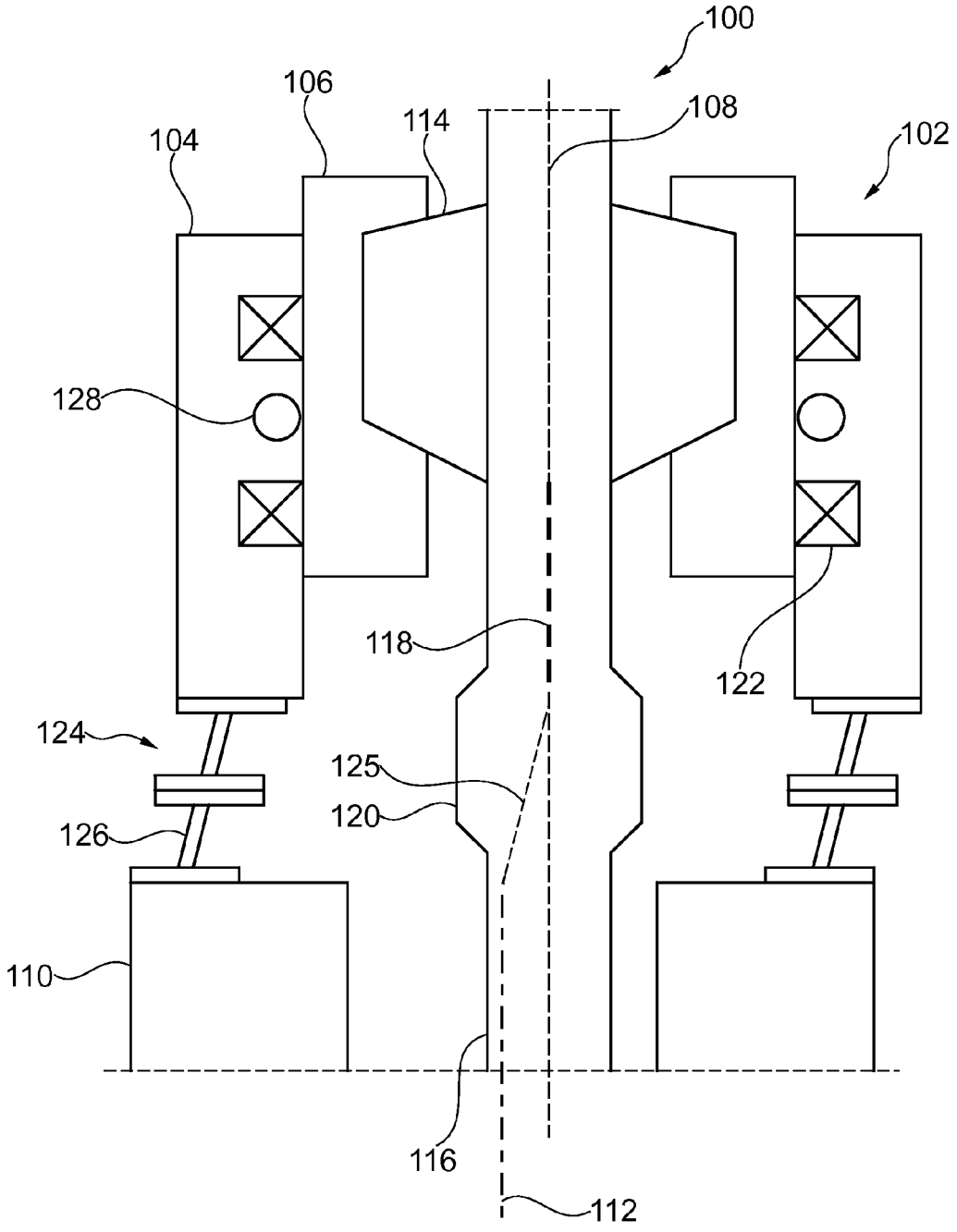
FIG. 1A shows adjustment components oriented to provide maximum offset to account for misalignment of BOP and shaft according to embodiments of the invention.

The ensuing description provides preferred exemplary embodiment(s) only, and is not intended to limit the scope, applicability or configuration of the invention. Rather, the ensuing description of the preferred exemplary embodiment(s) will provide those skilled in the art with an enabling description for implementing a preferred exemplary embodiment of the invention. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments maybe practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Moreover, as disclosed herein, the term "storage medium" may represent one or more devices for storing data, including read only memory (ROM), random access memory (RAM), magnetic RAM, core memory, magnetic disk storage mediums, optical storage mediums, flash memory devices and/or other machine readable mediums for storing information. The term "computer-readable medium" includes, but is not limited to portable or fixed storage devices, optical storage devices, wireless channels and various other mediums capable of storing, containing or carrying instruction(s) and/or data.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a machine readable medium such as storage medium. A processor(s) may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Embodiments of the present invention provide alignment pieces to ensure that axes of the rotating control device (RCD), drill shaft, and the blowout preventer (BOP) are aligned within a desired tolerance. Such alignment techniques can be utilized in any systems where eccentricity of rotating parts is not desirable. Embodiments of the invention further provide sensors used to detect physical characteristics of the sealing element and drill equipment to monitor a condition of the sealing element. This allows a remaining life of the sealing element to be predicted so that a sealing element replacement can be scheduled prior to a catastrophic failure of the component that could lead to increased downtime of the drilling operation and added costs.

A Rotating Control Device (RCD) is a device used to seal the top of a drilling annulus in a pressure drilling system such that the interior of the drilling annulus can remain pressurized. On a land rig, the RCD is typically mounted on the BOP and the well head. Above the RCD, the drill pipe or shaft is located in the top drive, the derrick, and the oil rig. Any misalignment of the rig with the well head will result in the drill pipe being eccentric in the RCD. This generates side forces and lateral deformation in the sealing element, resulting in accelerated fatigue and early failure. RCDs can include a large flexible annular element (i.e., the sealing element) that seals on the drill pipe and is mounted in a seal assembly to allow rotation and to seal the borehole during drilling so that pressure of the system can be managed. The flexible element is sufficiently flexible to allow tool joints on the drill pipe to be pulled through the device. Catastrophic failure often occurs as a result of one or more radial fractures in the flexible element.

A BOP is a large valve at the top of an oil well that may be closed to control formation fluids. By opening and closing the BOP, pressure control of the formation can be maintained. BOPs come in a variety of styles, sizes and pressure ratings. Some BOPs can effectively close over an open wellbore, while others can seal around tubular components in the well or can be fitted with hardened steel shearing surfaces that can cut through drill pipe. BOPs are critically important to the safety of the crew, the oil rig and the wellbore itself.

Alignment and Offset Correction

Figure 1B:
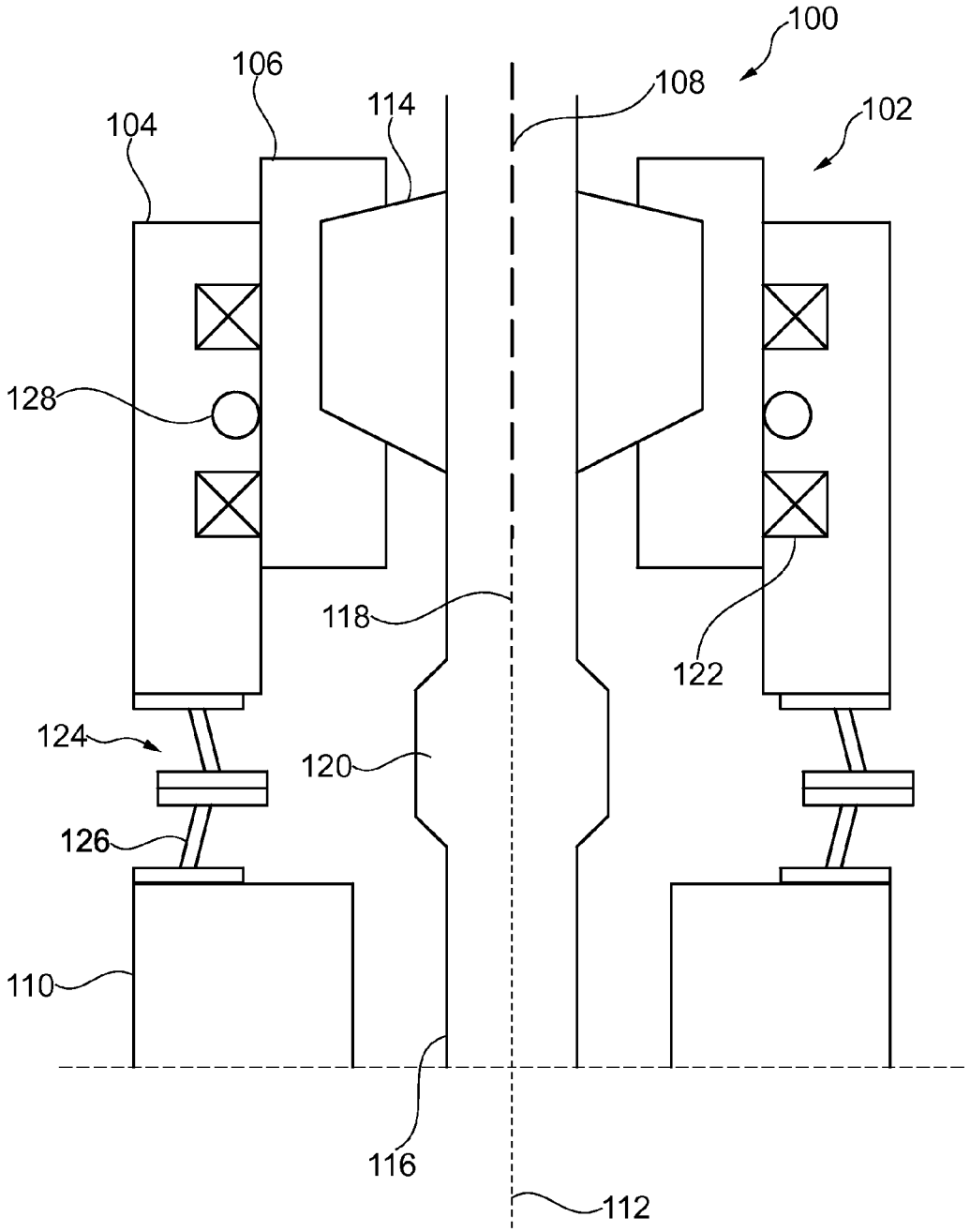
FIG. 1B shows adjustment components oriented to provide minimum offset to account for misalignment of BOP and shaft according to embodiments of the invention.

FIGS. 1A and 1B show drill systems 100 utilizing alignment components to account for misalignment of a shaft, RCD, and BOP. In FIG. 1A, RCD 102 is shown coupled atop BOP 110. BOP 110 can be coupled with a top end of a well head (not shown) and can include a longitudinal axis 112. RCD 102 includes a support section 104, a rotating section 106 and a sealing element 114. Typically, support section 104 is coupled with BOP 110, such as by bolting or other mechanical fastening. Rotating section 106 is often disposed inside of support section 104 and can define an interior of a drilling annulus or chamber. Rotating section 106 can rotate relative to support section 104 via bearings 122. Rotating section 106 can be configured to receive sealing element 114 within the interior of rotating section 106. Sealing element 114 can be positioned in the interior of rotating section 106 and can seal a top of the drilling annulus against a drill pipe or other shaft 116 of the pressure drilling system. The sealing element 114 allows rotation of the shaft 116 and seals the well head during drilling so that pressure of the system can be managed. Shaft 116 can include a shaft axis 118 that extends longitudinally through a center of shaft 116. Shaft 116 is typically inserted within BOP 110.

Oftentimes, the longitudinal axis 112 and the shaft axis 118 are radially offset from one another to some degree as shown in FIG. 1A. The misalignment of axes 112 and 118 is typically less than about 6 inches, and more commonly about 3 inches, although the misalignment may vary. This can occur, for example, in land rigs when the RCD 102 and BOP 110 are aligned to the well head and the shaft 116 is aligned to the rig. Sealing element 114 can be made of any flexible material, such as rubber. In some embodiments, sealing element 114 can be an annular disc. The material of sealing element 114 is commonly sufficiently elastic and/or flexible to allow a tool joint 120 of shaft 116 to be pulled or pushed through sealing element 114 while maintaining a seal against shaft 116 throughout the movement. In some embodiments, tool joint 120 can be 1 to 1.5 inches or more larger in diameter than shaft 116.

During rotation of the RCD 102, any eccentricity or misalignment in the system 100 is taken up in sealing element 114. Eccentricity within the system 100 is often caused by the misalignment between BOP 110 and shaft 116. To correct for this misalignment and to reduce or eliminate eccentricity within system 100, one or more alignment components 124 can be positioned between and coupled with either BOP 110, support section 104, or both BOP 110 and support section 104 such that an axis 108 of the RCD 102 and/or an axis 118 of shaft 116 are adjusted relative to the longitudinal axis 112 of BOP 110.

Alignment components 124 allow support section 104 to be radially offset from BOP 110 to be aligned with the pressure drilling system equipment (e.g., an oil rig) and shaft 116. In this manner, the offset or misalignment between the shaft axis 118 and the longitudinal axis 112 of the BOP 110 can be accommodated, or otherwise accounted for, by alignment component 124. In some embodiments, alignment component 124 can include a pair of alignment components 124 coupled with the support section 104 and the BOP 110 such that an axis 108 of the RCD 102 is shifted radially relative to the BOP 110. The pair of alignment components 124 may be radially movable relative to one another such that the misalignment of the BOP 110 and RCD 102 is accommodated.

In some embodiments, alignment components 124 can include one or more off-set spool pieces 126, which are components having an angled middle section and one or more flanged ends. In some embodiments, off-set spool pieces 126 can be formed from pieces of pipe, beam, conduit or other material. Each off-set spool piece 126 may include an angled middle portion coupled with two flanged ends. For example, as shown in FIG. 1A, each off-set spool piece 126 can include a middle portion having two flanged ends. In some embodiments, a pipe can be cut at an angle on a top end and a bottom end to create a slanted or angled pipe section having parallel top and bottom ends. A flange can then be welded or otherwise coupled with each end of the pipe such that the flanges are offset from each other. In some embodiments, the slanted or angled pipe section may have an angle of offset of less than or about 45 degrees.

An factor of the alignment components 124 is the integrity of the component. The ability to assemble the system and attach bolts into the flanged ends is also an aspect of the components 124. In other embodiments, the pipe can be cut at a right angle to create a pipe with a roughly rectangular side profile. The flanges can then be welded or otherwise coupled with the pipe at an offset to each other to create a similar alignment effect as the off-set spool pieces 126 formed from angle-cut pipe.

The off-set spool piece(s) 126 can be positioned with respect to BOP 110 and RCD 102 so that a longitudinal axis of the middle portion is angled relative to the longitudinal axis 112 of the BOP 110 and axis 108 of RCD 102. Further, the two off-set spool pieces 126 may be shifted radially relative to one another to orient the off-set spool pieces 126 differently relative to each other. In some embodiments, the flanges of spool pieces 126 may be aligned for increased stability where an inner edge of a flange of the first spool piece is lined up with the inner edge of an adjacent flange of the second spool piece. In other embodiments, flanges of spool pieces may be shifted relative to one another to allow for increased misalignment/offset correction, such as where an inner edge of a flange of a first spool piece is aligned with a middle portion of a flange of a second spool piece.

Using two off-set spool pieces 126 in combination enables the alignment component 124 to account for a wide range of offsets or misalignments of the BOP 110, RCD 102, and shaft 116. In other embodiments, a single off-set spool piece 126 may be coupled with the BOP 110 and RCD 102 to account for a misalignment between these components. In still other embodiments, three or more off-set spool pieces 126 may be coupled together between the BOP 110 and RCD 102 to account for a misalignment between these components.

In the illustrated embodiments using two off-set spool pieces 126, the spool pieces 126 may be oriented in any way to adjust for a common amount of misalignment in the system 100. By using two off-set spool pieces 126 in this manner, the number of alignment components 124 that are needed at the drilling site can be minimized. FIGS. 1A and 1B show two embodiments of how the off-set spool pieces 126 may be oriented to account for varying misalignments of the BOP 110, RCD 102, and shaft 116. It should be realized, however, that the off-set spool pieces 126 may be oriented in a variety of other ways, relative to one another and/or to the BOP 110 and RCD 102, to account for a misalignment of the components.

As shown in FIG. 1A, two off-set spool pieces 126 are provided in an orientation to account for an increased misalignment between BOP 110, RCD 102, and shaft 116. Here, a longitudinal axis of each spool piece 126 is angled in the same direction and/or to roughly the same degree relative to the longitudinal axis 112 of the BOP 110. Both longitudinal axes of the spool pieces 126 are aligned such that spool pieces 126 cooperate to increase the offset or misalignment correction achieved. For example, the longitudinal axes of the spool pieces 126 are aligned so as to define an angular axis 125 that corresponds to the misalignment of the BOP 110, RCD 102, and shaft 116. The spool pieces 126 are coupled with a top portion of the BOP 110 and a bottom portion of the RCD 102 so that the axes, 108 and 118, of the RCD 102 and shaft 116, respectively, are shifted radially relative to axis 112 of BOP 110 as shown. In this configuration, the eccentric stress induced on the sealing element 114 is minimized or otherwise reduced during operation of the pressure drilling system equipment carried out on an oil rig.

FIG. 1B shows the off-set spool pieces 126 oriented to account for smaller misalignment between BOP 110, RCD 102, and shaft 116. Here, the spool pieces are oriented such that the longitudinal axes of the spool pieces 126 are angled opposite each other. In this configuration, the spool pieces 126 are aligned such that the longitudinal axes compete or counteract one another and thereby decrease the offset or misalignment achieved. This may result in little to no offset correction and may be useful in situations where minimal or no offset is needed between the shaft axis 118 and the longitudinal axis 112 of BOP 110. For example, the longitudinal axes of the spool pieces 126 may be aligned so as to define an angular axis (not shown) corresponding to a minor misalignment of the BOP 110, RCD 102, and shaft 116.

The spool pieces 126 may be coupled with a top portion of the BOP 110 and a bottom portion of the RCD 102 so that the axes, 108 and 118, of the RCD 102 and shaft 116, respectively, are shifted radially relative to axis 112 of BOP 110 by a minor amount. As with FIG. 1A, this configuration may also reduce or minimize the eccentric stress induced on the sealing element 114 during operation of the pressure drilling system. While FIGS. 1A and 1B show extreme orientations of the spool pieces 126, it should be realized that the spool pieces 126 may be positioned in any other orientation to account for offsets between these extreme conditions.

As described above, alignment components 124 allow the RCD 102 to be aligned with the pressure drilling system equipment (e.g., oil rig equipment) instead of the BOP 110 to ensure the shaft axis 118 and the longitudinal axis 112 have minimal offset. This reduces or eliminates the eccentricity in the shaft 116 during rotation that could cause premature failure of the sealing element.

Figure 2:
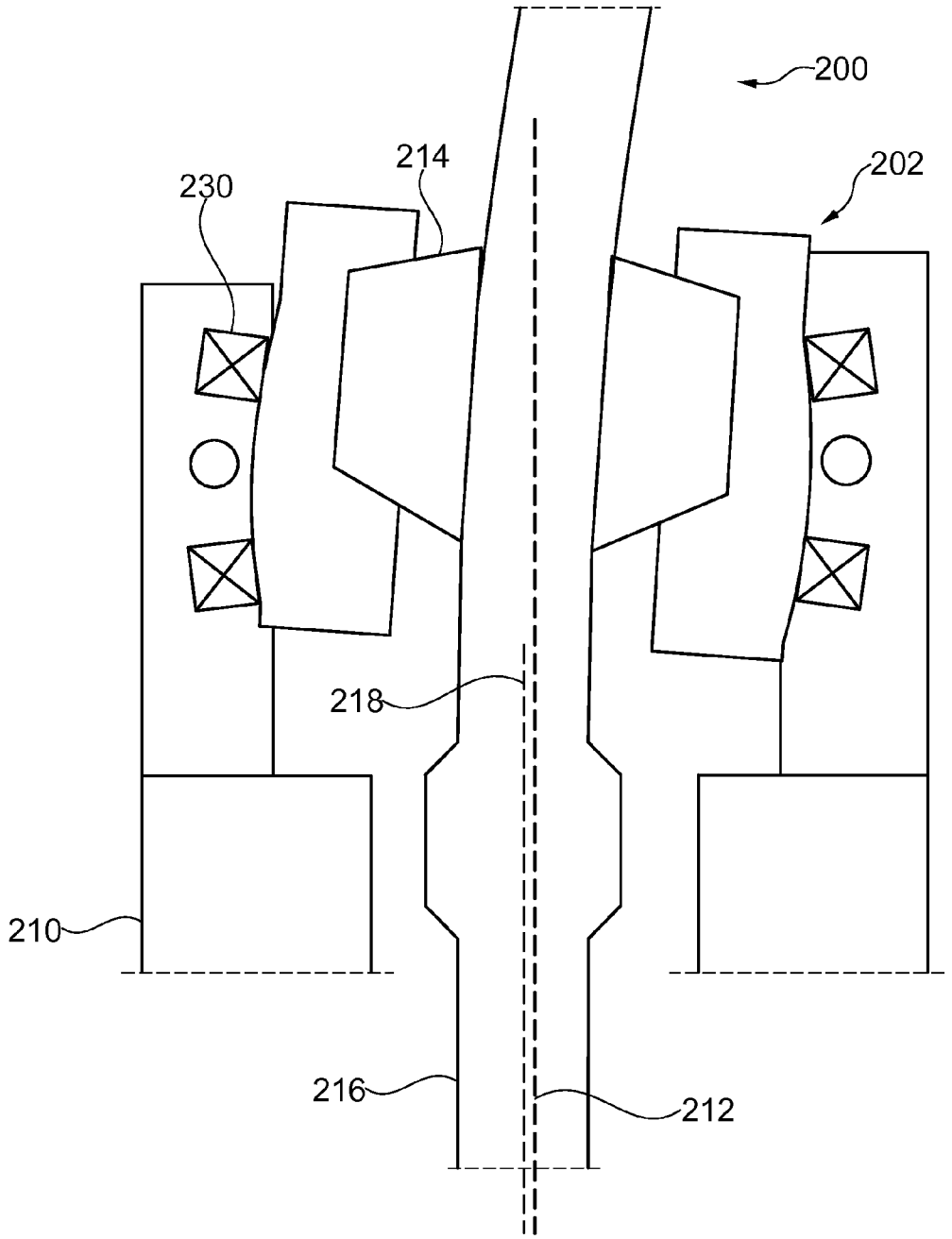
FIG. 2 shows a spherical bearing implemented with a rotating control device to account for misalignment of BOP and shaft according to embodiments of the invention.

In some embodiments, alignment component 124 can include a bearing that enables rotation of the rotating section 106 of the RCD 102 and also enables a portion of the RCD 102 to tilt. For example, FIG. 2 illustrates a drilling system 200 that utilizes a spherical bearing 230 for alignment of a BOP 210 and a RCD 202. RCD 202 can be coupled directly to BOP 210. In some embodiments, RCD 202 and BOP 210 can be coupled with alignment components, such as those described in FIGS. 1A and 1B, to provide additional alignment correction. RCD 202 can include a spherical bearing 230 to enable the rotation of the RCD 202 and a sealing element 214 just as the cylindrical bearing 122 described above with regard to FIGS. 1A and 1B. Spherical bearing 230 also allows RCD 202 and shaft 216 to tilt, thus accounting for some degree of offset between shaft axis 218 and longitudinal axis 212 of BOP 210. In some embodiments, tilting an RCD can be achieved by mounting the RCD on gimbals, using a compliant mounting system similar to an engine bearing system in a vehicle, or by use of a hydraulic device.

Figure 3:
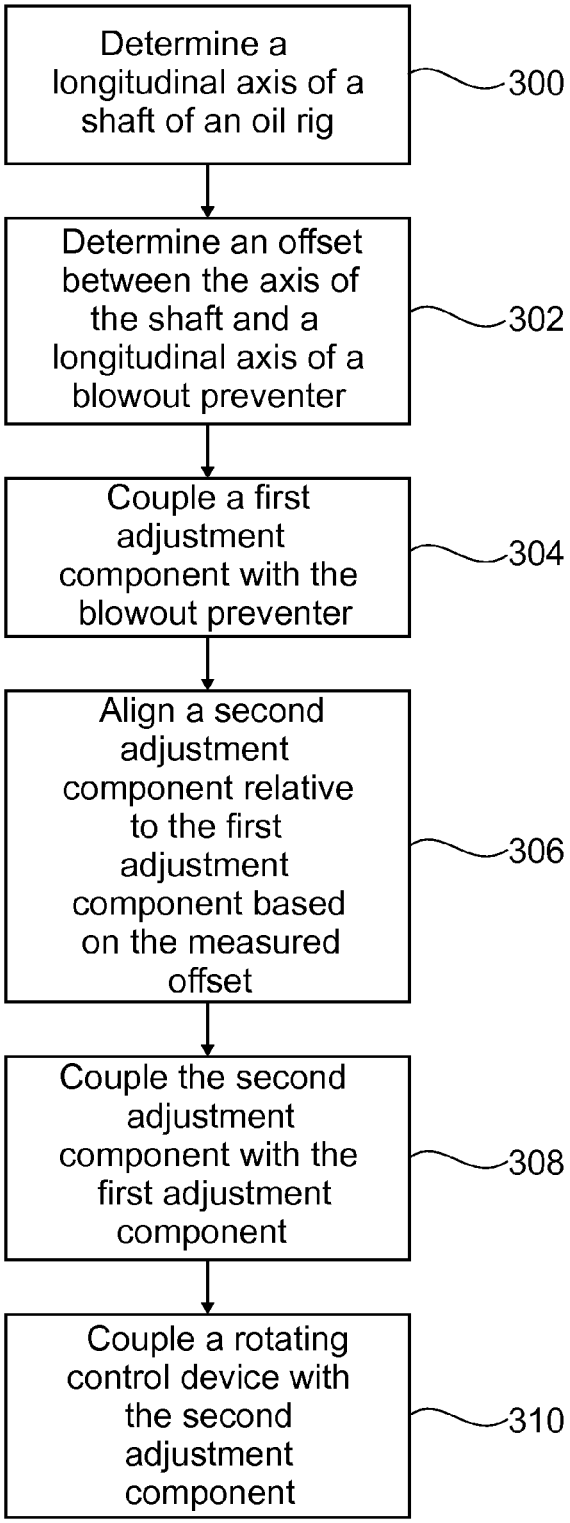
FIG. 3 shows a flowchart of a method of aligning oil drilling equipment according to embodiments of the invention.

FIG. 3 provides a method of aligning oil drilling equipment. The method can include determining a longitudinal axis of a shaft of the pressure drilling system (e.g., an oil rig) at block 300. In some embodiments, the longitudinal axis may be determined by attaching a laser device to a bottom of the shaft or other equipment such that a beam of the laser device corresponds to the longitudinal axis of the shaft, moving the shaft, and monitoring a position of the beam produced by the laser device.

Monitoring the beam position can be done visually, using sensors, or using any other detection techniques. Determining the longitudinal axis can further include rotating the shaft and monitoring a position of the beam. This can help identify eccentricity within the drilling equipment associated with misalignment. In other embodiments, determining the longitudinal axis can include coupling a plumb line with the shaft to detect the longitudinal axis. For example, a weight suspended from a cable or other line may be hung from a central portion of a bottom surface of the shaft or other equipment such that the hanging weight and line indicate a longitudinal axis of the shaft.

An offset between the axis of the shaft and a longitudinal axis of a blowout preventer can be determined at block 302. A first adjustment component may be coupled with the blowout preventer at block 304. At block 306, a second adjustment component may be aligned relative to the first adjustment component based on the measured offset. In some embodiments, the first and second adjustment components can each include an angled middle portion coupled with two flanged ends. The second adjustment component may be coupled with the first adjustment component at block 308. A rotating control device may be coupled with the second adjustment component at block 310 such that an axis of the rotating control device corresponds with the axis of the shaft to account for the measured offset. The method can also include positioning a sealing component between the shaft and the rotating control device to seal a drilling annulus for pressurized drilling operations. In some embodiments, the sealing component can be a rubber annular disc.

Condition Monitoring and Failure Prediction

Oftentimes, fatigue driven mini fractures form within the body of the sealing element prior to a catastrophic failure of the sealing element. Locally, these mini fractures may change the stress strain response of the sealing element. As a tool joint of the shaft is pulled through the sealing element, the flexing of the sealing element can cause a massive distortion of the sealing element. In a failing sealing element, local changes or fractures typically change the response to this distortion. By monitoring such changes, the condition of the sealing element can be characterized.

Global changes can also be considered. For example, a change in stiffness of the sealing element may change the amount of force required to pull a tool joint of the shaft through the sealing element. By tracking load measurements as each tool joint passes through the sealing element, changes in the response that indicate failure of the sealing element can be detected.

Referring back to FIG. 1A, a system 100 for predicting a failure of a sealing element of a pressure drilling system is shown. As described above, system 100 includes BOP 110 coupled with RCD 102. System 100 also includes a sealing element 114 configured to seal against a shaft 116 disposed within the RCD 102. Physical responses of the sealing element 114 during rotation of shaft 116 or during interactions with tool joint 120 of shaft 116 can be monitored and tracked over time to identify changes in the response. Changes in the response can include precursors to failure, which are used to predict a remaining life or an impending catastrophic failure of the sealing element 114. Additionally, catastrophic failure can result in damage to other components of system 100. Thus, response detection and failure prediction save considerable time and money associated with failure of the sealing element.

Replacement of sealing element 114 can be scheduled based on the remaining life and/or predicted impending catastrophic failure. Such replacement scheduling can result in improvements in safety and integrity of the entire drilling operation, as well as reduce time and cost associated with the replacement of the sealing element and/or other components that may be damaged by a catastrophic failure of the sealing element 114. Precursors to failure can include any changes in response of material of the sealing element 114 that are detected. For example, changes could include changes in symmetry or magnitude of the responses as compared to responses from previous cycles. These changes in response can be associated with fractures occurring within the sealing element 114 that indicate an impending failure of the sealing element 114.

For example, the failure mechanism for sealing element 114 is often a radial fracture from an inner edge of sealing element 114 across to an outer edge of sealing element 114. Prior to failure, measurements such as stress and strain are fairly uniform throughout sealing element 114. Some non-uniform measurements may exist, especially in sealing elements that have been cast or molded, where heterogeneity in the material can result in local variations of stiffness. However, the system response will be non-uniform, but repeatable in a non-damaged sealing element 114. The repeatability enables the responses to be tracked such that any detected changes signify structural changes to the sealing element that may indicate impending failure.

The sealing element 114 can include a conductive material, typically added upon formation of the sealing element 114. In some embodiments, the conductive material may be carbon black, although other conductive material may be used, alone or in conjunction with carbon black. System 100 can further include a pair or network of electrodes (not shown) that monitor an electrical resistance of the sealing element 114 to determine if the sealing element 114 has been damaged or if other changes to the condition of the sealing element 114 have occurred. Changes in the electrical resistance of the sealing element 114, either instantaneous or in relation to historical data, may signal damage or other changes to the condition of the sealing element that warrant further consideration or that identify a pending failure of the sealing element 114. A further investigation of the sealing element 114 or a maintenance or replacement of the sealing element 114 may then be scheduled. In other embodiments, the operating conditions of the pressure drilling system equipment may be adjusted to reduce stress on and/or enhance the life of the sealing element 114.

System 100 may further include one or more sensors 128 coupled with one or more of the sealing element 114, the BOP 110, the shaft 116, or the RCD 102 to monitor characteristics of one or more of the components. Sensors 128 can be disposed in proximity with sealing element 114, such as above, behind, below, in, or on sealing element 114. In some embodiments, the sensors 128 can be disposed on the rotating section 106, such as by using a rotary encoder (not shown) to correlate load measurements to rotation of the shaft. For example, a rotary encoder can be configured to detect changes in a rotary speed of the shaft 116 such that changes in lateral stiffness of the sealing element 114 are identifiable when the shaft 116 is eccentric in the RCD 102. These changes can indicate precursors to failure.

Other embodiments may include the sensors 128 disposed on the support section 104. In some embodiments, the sensors 128 can be configured to detect deformation of the sealing element 114 associated with a tool joint 120 of the shaft 116 as the tool joint 120 is pulled through the sealing element 114. The deformation responses of the sealing element 114 can be monitored to detect or otherwise identify any changes in a deformation pattern associated with the sealing element 114. For example, sensors 128 can detect deformation of the sealing element 114 such that any change in the symmetry or magnitude of the deformation that indicates failure of the sealing element 114 may be identified. Sensors 128 can include one or more of strain gauges, stress sensors, temperature sensors, load cells, deformation sensors, pressure sensors, and the like.

Sensors 128 can be configured to detect signals indicating an impending failure of the sealing element 114 such that a sealing element replacement procedure can be scheduled based at least in part on a predicted remaining life of the sealing element 114. Additionally, rotation of the shaft 116 can be slowed, the amount of coolant used in the system 100 can be increased, and/or other precautions can be taken to prolong a life of the sealing element 114 and/or otherwise delay a replacement procedure until a desirable time based on the predicted remaining life.

Figure 4:
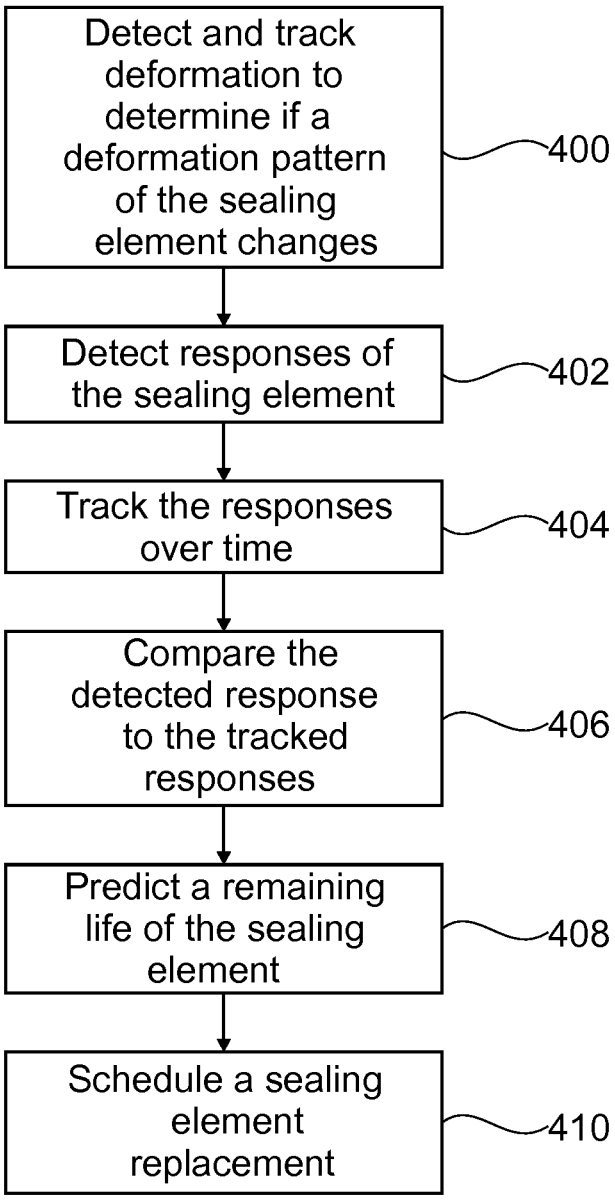
FIG. 4 depicts a flowchart of a method of detecting a condition of a sealing element of a pressure drilling system according to embodiments of the invention.

FIG. 4 illustrates a method for predicting failure of a sealing element of a pressure drilling system. Deformation associated with a tool joint of a shaft as the tool joint is pulled through a sealing element of an RCD can be detected and tracked to determine if a deformation pattern of the sealing element changes at block 400. Responses of the sealing element due to one or more of stress, strain, temperature, mechanical load, pressure, and the like may be detected using a network of sensors in or around the sealing element at block 402.

Response detection can occur during shaft rotation and tool joint interactions that occur during operation of the RCD in an oil exploration procedure. In some embodiments, the detection includes detecting or measuring deformation of the sealing element and identifying any change in the symmetry or magnitude of the deformation that indicates impending failure of the sealing element or is otherwise indicative of damage to the sealing element. Identification of changes can include comparing the measured deformation to historical data.

In other embodiments, the response detection includes comparing sensed responses of a network of sensors positioned in proximity to the sealing element. The sensors can include one or more of strain gauges, stress sensors, temperature sensors, load cells, deformation sensors, pressure sensors, and the like. At block 404, the responses can be tracked over time. The detected responses are compared to tracked responses at block 406 to identify changes in the symmetry of the responses over time and/or changes in magnitude of the responses over time. For example, the detected response can be compared to data of previously detected responses to identify structural changes in the sealing element by determining a deviation of the detected response from a typical response of the data of previously detected responses. The changes can be associated with fractures occurring within the sealing element.

In some embodiments, variations in a rotary speed of the shaft can be detected to identify changes in lateral stiffness of the sealing element. For example, radial fractures often form from an inner edge of the sealing element to an outer edge of the sealing element as the sealing element approaches catastrophic failure. The change in the local stiffness of the element caused by these fractures will cause a modulation in the rotary speed of the element as it rotates.

Using a rotary encoder to measure the element position and derive the instantaneous speed will enable detection of this modulation and warning that these fractures are forming. In other embodiments, the sealing element can include a conductive material. An electrical resistance of the sealing element may be sensed and changes in the electrical resistance can be detected which are indicative of damage to the sealing element. At block 408, a remaining life of the sealing element may be predicted based on the structural and/or response changes. A sealing element replacement time may be scheduled at block 410 based at least in part on the predicted remaining life.

It should be noted that the methods, systems, and devices discussed above are intended merely to be examples. It must be stressed that various embodiments may omit, substitute, or add various procedures or components as appropriate. For instance, it should be appreciated that, in alternative embodiments, the methods may be performed in an order different from that described, and that various steps may be added, omitted, or combined. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known, processes, structures, and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Also, it is noted that the embodiments may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

What is claimed is:

1. A method of aligning oilfield drilling equipment, the method comprising:

determining a longitudinal axis of a shaft of a drilling rig;

determining an offset between the axis of the shaft and a longitudinal axis of a blowout preventer;

coupling a first adjustment component with the blowout preventer;

aligning a second adjustment component relative to the first adjustment component based on the measured offset;

coupling the second adjustment component with the first adjustment component; and coupling a rotating control device with the second adjustment component such that an axis of the rotating control device corresponds with the axis of the shaft to account for the measured offset;

positioning a sealing component between the shaft and the rotating control device; and installing a sensor on one or more of the shaft, sealing component, blowout preventer, and rotating control device;

wherein the first and second adjustment components each comprise an angled middle portion coupled with one or more flanged ends.

2. The method according to claim 1, wherein determining the longitudinal axis comprises attaching a laser device to a bottom of the shaft such that a beam of the laser device corresponds to the longitudinal axis, moving the shaft, and monitoring a position of the beam produced by the laser device.

3. The method according to claim 2, wherein determining the longitudinal axis further comprises rotating the shaft and monitoring a position of the beam.

4. The method according to claim 1, wherein determining the longitudinal axis comprises coupling a plumb line with the shaft to detect the longitudinal axis.

5. The method according to claim 1, wherein the sealing component comprises a rubber annular disc.

6. A method of aligning oil drilling equipment, the method comprising:

determining a longitudinal axis of a shaft of a drilling rig;

determining an offset of between the axis of the shaft and a longitudinal axis of a blowout preventer;

coupling a first adjustment component with the blowout preventer;

coupling a rotating control device with a second adjustment component such that an axis of the rotating control device corresponds with the axis of the shaft to account for the offset positioning a sealing component between the shaft and the rotating control device; and installing a sensor on installing a sensor on one or more of the shaft, sealing component, blowout preventer, and rotating control device wherein the first and second adjustment components each comprise an angled middle portion coupled with one or more flanged ends.

7. The method according to claim 6, wherein determining the longitudinal axis comprises attaching a laser device to a bottom of the shaft such that a beam of the laser device corresponds to the longitudinal axis, moving the shaft, and monitoring a position of the beam produced by the laser device.

8. The method according to claim 7, wherein determining the longitudinal axis further comprises rotating the shaft and monitoring a position of the beam.

9. The method according to claim 6, wherein determining the longitudinal axis comprises coupling a plumb line with the shaft to detect the longitudinal axis.

10. The method according to claim 6, wherein the sealing component comprises a rubber annular disc.

11. A system of equipment of a managed pressure drilling operation being carried out on a drilling rig, the system comprising:

a shaft of a drilling rig, the shaft having a shaft axis;

a blowout preventer coupled with a top end of a well bore, the blowout preventer being configured to receive the shaft and having a longitudinal axis that is radially offset from the shaft axis;

a rotating control device; and an alignment component coupled with at least one of the rotating control device and the blowout preventer such that an axis of the rotating control device is adjusted relative to the blowout preventer via the alignment component;

a sealing element coupled with the rotating control device to provide a seal against an outside of the shaft; and a sensor positioned on one or more of the shaft, sealing component, blowout preventer, and rotating control device;

wherein the alignment component comprises one or more pieces positioned between the rotating control device and the blowout preventer, each piece comprising an angled middle portion coupled with one or more flanged ends.

12. The system according to claim 11, wherein the alignment component comprises a bearing that enables rotation of a first portion of the rotating control device and enables a second portion of the rotating control device to tilt.

13. The system according to claim 11, wherein the sealing element comprises a rubber annular disc.

14. The system according to claim 11, wherein the sealing element is sufficiently elastic to allow one or more joints on the shaft to be pulled through the sealing element while maintaining a seal before, during, and after the joints are pulled through the sealing element.

15. The system of according to claim 11, wherein the alignment component comprises a pair of components that are radially movable relative to one another.

* * * * *